United States Patent [19]

Flaum et al.

[11] 4,351,264

[45] Sep. 28, 1982

[54] ADHESIVE METERING DEVICE

[75] Inventors: Stephen S. Flaum, Brooklyn; Martin J. Leff, New York, both of N.Y.

[73] Assignee: S&S Corrugated Paper Machinery Co., Inc., Brooklyn, N.Y.

[21] Appl. No.: 222,754

[22] Filed: Jan. 5, 1981

Related U.S. Application Data

[63] Continuation of Ser. No. 22,141, Mar. 20, 1979, abandoned.

[51] Int. Cl.[3] ..... B05C 1/08

[52] U.S. Cl. ..... 118/203; 118/259; 118/261

[58] Field of Search ..... 118/203, 259, 261, 410, 118/413; 101/366

[56] References Cited

U.S. PATENT DOCUMENTS

| | | | |
|---|---|---|---|
| 2,243,333 | 5/1941 | Diescher | 118/410 |
| 2,787,244 | 4/1957 | Hecker | 118/259 |
| 2,796,846 | 6/1957 | Trist | 118/410 |
| 2,862,471 | 12/1958 | Sidebotham, Sr. et al. | 118/259 |
| 3,046,935 | 7/1962 | Wilson | 118/674 |
| 3,379,171 | 4/1968 | Cordingly et al. | 118/261 |
| 3,418,970 | 12/1968 | Phelps et al. | 118/410 |
| 3,703,459 | 11/1972 | Little, Jr. et al. | 118/259 X |

*Primary Examiner*—John P. McIntosh

*Attorney, Agent, or Firm*—Ostrolenk, Faber, Gerb & Soffen

[57] ABSTRACT

A glue applicating means is constructed with an elongated shoe floatingly mounted alongside of and urged toward a glue applicator roll by a fluid controlled biasing means. A longitudinally extending depression in the shoe is substantially closed by the glue roll to define a glue cavity to which glue is fed by a positive displacement pump. The shoe is mounted so that the downstream end of the shoe is movable away from the glue roll automatically as required to permit glue to exit from the cavity at the same rate it is supplied thereto. This provides what is effectively a self-adjusting nozzle or metering slot extending the full length of the shoe and through which glue is forced from the cavity to form a thin layer of uniform thickness on the outside of the glue roll.

17 Claims, 5 Drawing Figures

310
311
312
314
315
316
317
318
319
321
324
401
402
405
406
PUMP
99
96
40
42
48
100
47
11
18
19
101
104
A
B
C
D
S

ADHESIVE METERING DEVICE

This is a continuation of the now abandoned U.S. patent application Ser. No. 22,141, filed Mar. 20, 1979.

This invention relates to fluid metering devices in general and in particular relates to means for forming a glue film of controlled thickness on an applicator roll.

The hydrodynamics of glue makes it difficult to predict glue behavior accurately. In U.S. Pat. No. 3,046,935 issued July 31, 1962 to H. W. Wilson for a Gluing Control Means, devices are disclosed for controlling glue film thickness on an applicator roll as a function of machine speed and in this way control the amount of glue applied by the applicator roll to a moving member. Even though machine speed is of substantial significance in connection with application of known quantities of glue, perhaps a more significant factor is glue viscosity. That is, with prior art constructions, glue film thickness on an applicator roll was subject to relatively wide uncontrolled variations because of changes in glue viscosity brought on typically by reason of non-uniform glue quality and variation in glue temperature.

Another problem that arises with prior art devices which utilize metering rolls results from the fact that different glue mixtures result in different speed curves for the metering. These speed curves are difficult to determine and difficult to adjust.

In prior art devices having elongated glue rolls, mechanical imperfections, such as run out of the roll, prevent accurate formation of thin glue films. This last noted problem is becoming increasingly significant because of new adhesives which must be applied in especially thin films.

In accordance with the instant invention adhesive metering means is provided to assure that a known quantity of adhesive is placed on the applicator roll over a relatively wide range of machine speeds and despite the fact that glue viscosity varies over a considerable range.

In addition, the device of the instant invention is more readily kept running accurately despite practical problems of manufacture and maintenance.

More particularly, in accordance with the instant invention an elongated shoe is floatingly mounted alongside a glue applicator roll and is biased toward the roll. A glue cavity is formed through the cooperation of the outer surface of the applicator roll and a depression in the shoe. This cavity is always filled with glue and glue is delivered thereto by a positive displacement pump. The latter delivers a known quantity of glue over a relatively large range of glue viscosities. The glue pump delivers glue to the cavity at a pressure which forces glue out of the cavity through a metering slot along one edge thereof to form a glue film on the applicator roll. Since the cavity is always filled with glue, the amount of glue delivered by the pump over a given time interval is necessarily forced from the cavity through the metering slot so that a known quantity of glue is applied to the glue roll.

Accordingly, a primary object of the instant invention is to provide a novel, improved device for metering adhesives and other fluidized materials.

Another object is to provide an adhesive metering device of this type which utilizes a positive displacement pump to deliver a known quantity of glue to a cavity which is partially bounded by the glue applicator roll.

Still another object is to provide adhesive metering means of this type which is floatingly mounted alongside the glue applicator roll.

A further object is to provide adhesive metering means of this type which is constructed to assure that glue is applied evenly to the entire glue applicator roll.

These objects as well as other objects of this invention shall become readily apparent after reading the following description of the accompanying drawings in which:

FIG. 1 is a fragmentary side elevation of a double backer including a glue control means constructed in accordance with teachings of the instant invention.

FIGS. 2 and 3 are fragmentary end views of the glue control means taken through the respective lines 2—2 and 3—3 of FIG. 4 looking in the direction of arrows 2—2.

Figure 1:
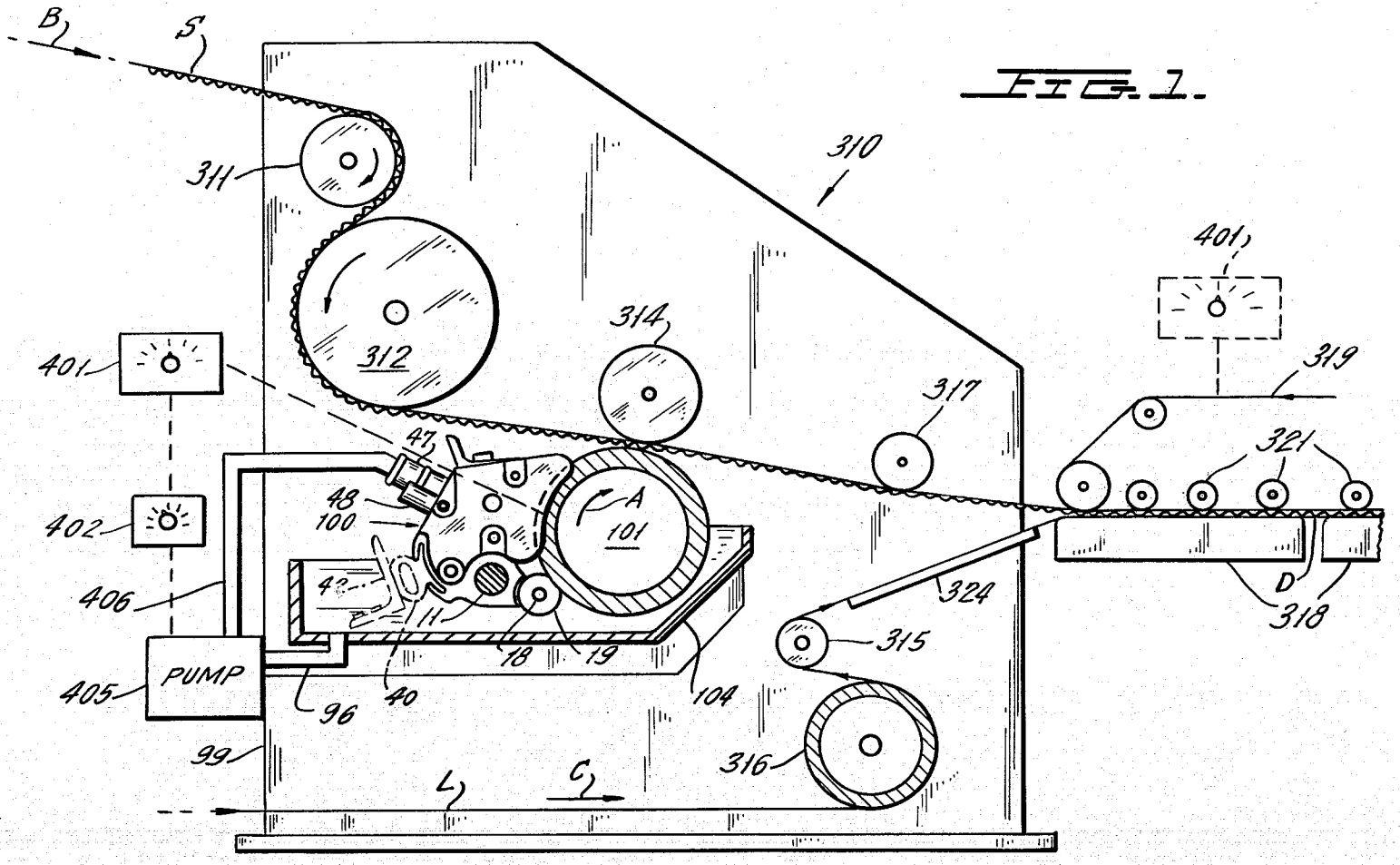
Figure 2:
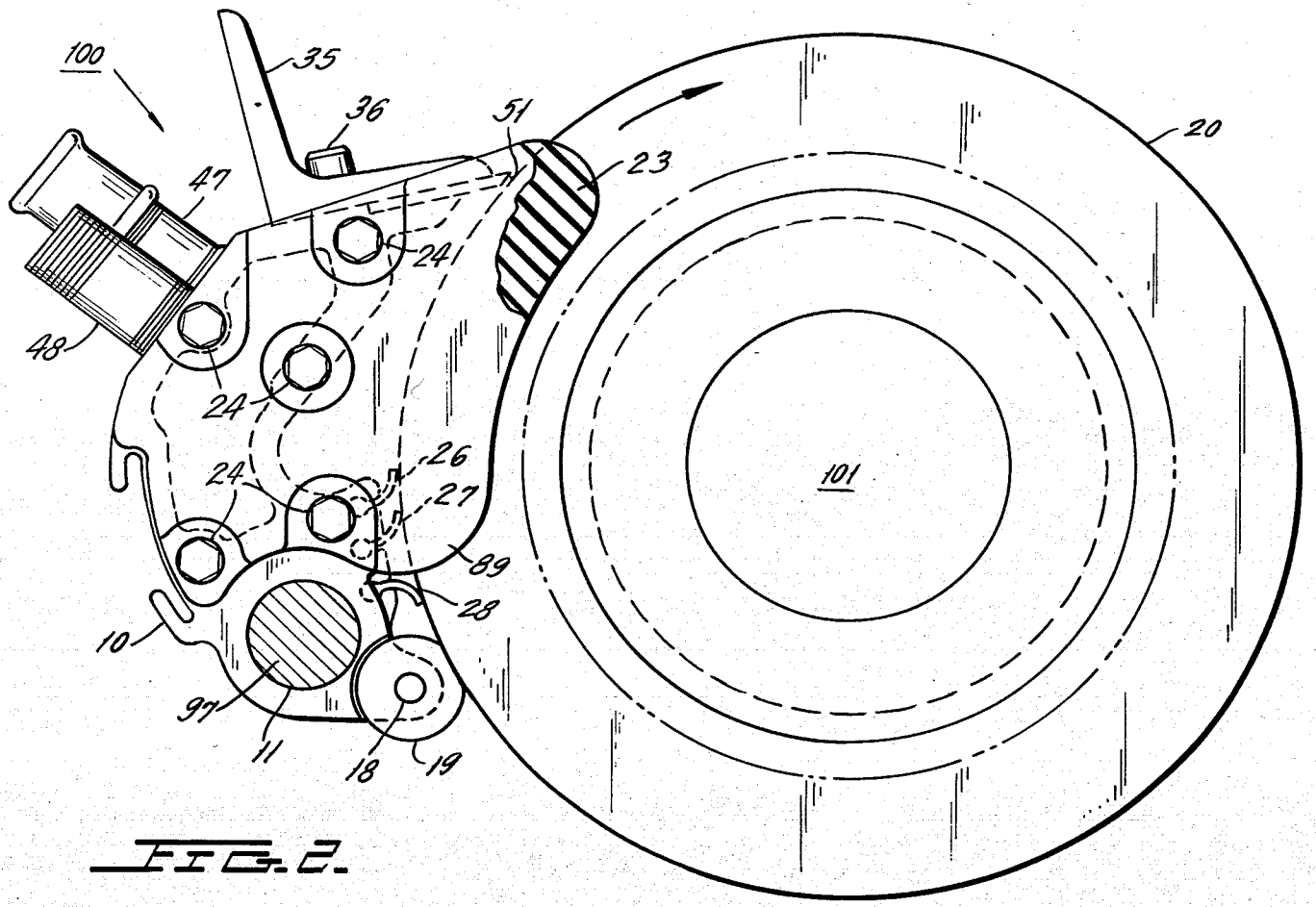
Figure 3:
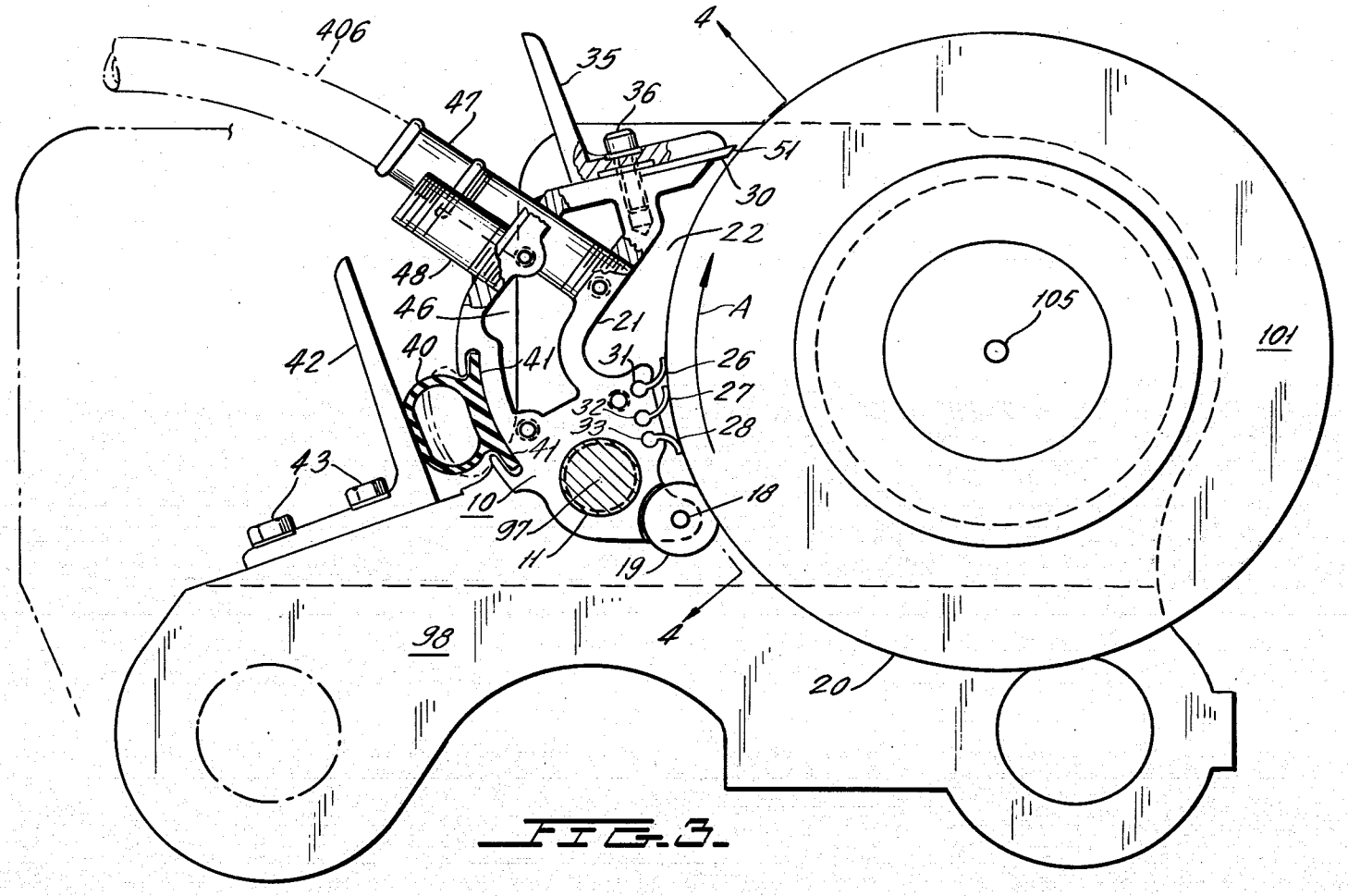
Figure 4:
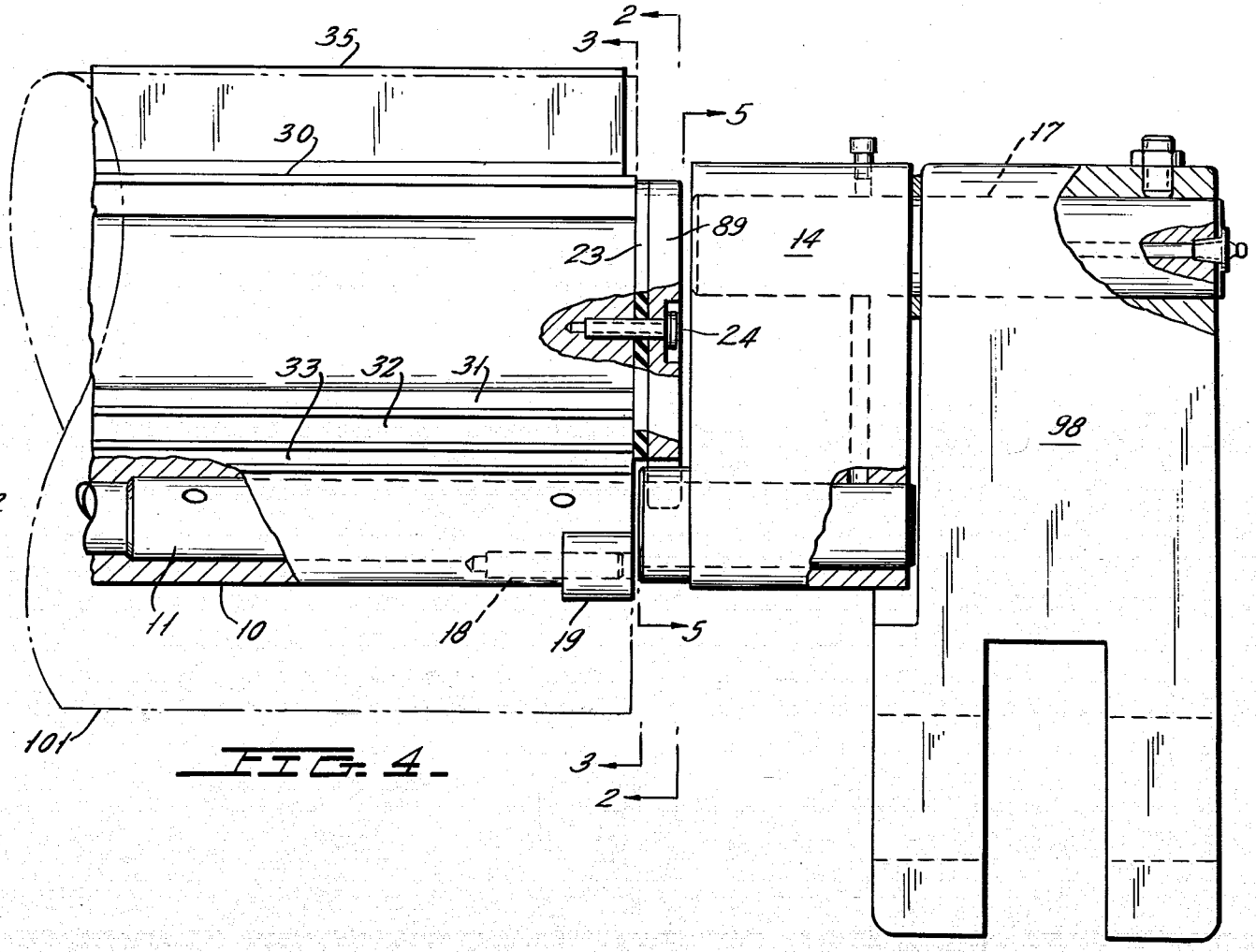
FIG. 4 is a side elevation of the glue control means shoe and mounting therefore looking in the direction of arrows 4—4 of FIG. 3.
Figure 5:
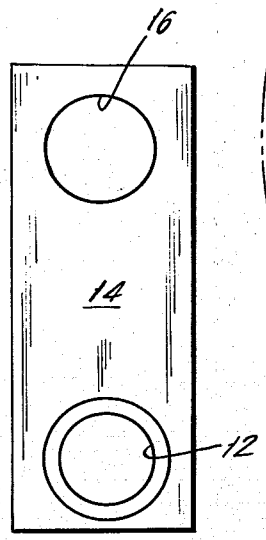
FIG. 5 is an elevation looking in the direction of arrows 5—5 of FIG. 4 and showing one of the pivoted arms to which the shoe of the glue control means is mounted.

Now referring more particularly to FIG. 1 which illustrates portion 310 of a double backer which provides double faced board D by adding a second line L to single faced board S. Single faced board S moves in the direction indicated by arrow B around idler roll 311, partially wraps around preheater drum 312 and passes through the nip between pressure roll 314 and glue applicator roll 101 where glue is applied to the free flute tips of single faced board S. Thereafter, the board S moves below deflector roll 317 into the nip between the lower flight of traction belt 319 and the upstream or leftmost steam chest 318 where liner L, moving in the direction of arrow C, joins single faced board S to form double face board D. Upstream of steam chests 318 liner L passes partly around rotating steam chest 316, partly around idler 315 and over support table 324. In a manner well known to the art, board D passes over and is supported by a plurality of steam chests 318 while being engaged from above by moving traction belt 319 have a plurality of weight rolls 321 acting downward on the lower flight thereof to maintain board D in heat transferring relationships with steam chests 318.

When the corrugating process being used does not require heating of liner L or heating of single faced board S, preheaters 312 and 316 may be eliminated and/or replaced by low friction supports, similarly, preheaters 312, 316 and steam chests 318 may be deactivated by not being heated. The latter may be replaced by low friction supports.

Adhesive transfer or glue roll 101 is an elongated cylinder fed with adhesive from pan 104. Metering means are provided for the application of a uniform adhesive coating on glue roll 101 by means of control head 100 constructed in accordance with the instant invention and to be hereinafter described in detail.

Glue roll 101 and traction belt 319 as well as other elements of the double backer are synchronously driven from single variable speed main drive 401 by means of appropriate gearing and chains. That is, main drive 401 has one output that drives roller 101 and belt 319, indirectly through the belt and paper and another output which supplies the input to adjustable ratio coupler 402.

The output of the latter is related to or synchronized with the input to coupler 402 furnished by main drive 401, and drives positive displacement glue pump 405. Typically, the latter is a piston pump which delivers a known quantity (volume) of glue for a given pump speed even though glue viscosity changes over a relatively wide range and/or there are relatively large changes in back pressure on the pump. Pump 405 receives glue from pan 104 and delivers glue through flexible conduit 406 to control head 100.

Now referring more particularly to FIGS. 2 through 5 for a detailed description of the glue metering means including control head 100. In a manner well known to the art, the opposite ends of glue roll 101 are of reduced diameter and are journalled in bearings (not shown) mounted to frame section 98 which is adjustably mounted on main frame 99 (FIG. 1). These bearings are so positioned that glue roll 101 is rotated about its cylindrical axis 105 by main drive 401 in a direction indicated by arrow A. Floatingly mounted rearward and alongside of glue roll 101 is elongated extruded shoe 10. Aligned rods 11 extend from opposite ends of shoe 10 into bores 12 at the lower ends of arms 14 whose upper ends are provided with bores 16 which receive aligned stub-shafts 17. The latter extend into aligned apertures in adjustable frame section 98. In this manner shaft sections 17 pivotally mount arms 14 to frame sections 98, and shafts 11 pivotally mount shoe 10 to the ends of arms 14 opposite shafts 17. As will hereinafter be seen, this permits shoe 10 to move forward and rearward with respect to frame member 98 on which shoe 10 is mounted.

Aligned stub shafts 18 at opposite ends of shoe 10 pivotally connect the latter to wear elements 19 which ride on the outer surface 20 of glue roll 101 in sliding engagement therewith. However, shoe 10 is free to pivot on the secondary axis defined by aligned stub shafts 18. This secondary axis is parallel to main axis 97 and glue cylinder axis 105.

The forward face of shoe 10 is provided with depression 21 which partially defines glue cavity 22. The latter is also bounded by a portion of glue roll surface 20. Five screws 24 at each end of shoe 10 secure plastic plates 23 and their backing plates 89 to opposite ends of shoe 10. Plates 23 define the end boundaries for glue cavity 22, and extend forward of shoe 10 to partially overlap the ends of glue roll 101 in glue sealing engagement therewith. Each of the three identical plastic splines 26, 27, 28 has an enlargement along one of its edges, that is captured within the respective longitudinal recesses 31, 32, 33 of shoe 10. Splines 26, 27, 28 are disposed upstream of cavity 22 with spline 26 providing the upstream edge seal between shoe 10 and glue roll surface 20. In the event spline 26 provides an imperfect seal against surface 20, spline 27 takes over this sealing function. The most upstream 28 of these three splines 26–28 has its free edge extending upstream into engagement with surface 20 to act as a scraper which removes glue from portions of surface 20 before they are opposite shoe depression 21. The glue removed by scraper 28 falls into glue pan 104 which is connected through tube 96 to the intake of glue pump 405. Additional scraper or other cleaner means (not shown) may be provided upstream of scraper 28.

The downstream edge boundary for glue cavity 22 is formed by doctor blade 30 which is clamped to shoe 10 by one leg of angle iron 35. Clamping pressure is provided by a plurality of screws 36. The forward or free edge of blade 30, is, as will hereinafter be seen, biased toward engagement with glue roll surface 20.

Oppositely extending legs 41, 41 of elongated expandable bladder 40 are captured in complementary recesses of shoe 10 open at the rear thereof. Bladder 40 abuts one leg of angle iron 42 whose other leg is secured by screws 43 to frame section 98.

Shoe 10 is also provided with longitudinal passage 46 whose opposite ends are sealed by plates 23. Fittings, 47, 48, threadably mounted to shoe 10, communicate with depression 21 and passage 46, respectively. Flexible hose 406 extends from glue pump 405 to fitting 47. For a reason to be hereinafter explained, fitting 48 may be connected to a source of temperature controlling fluid (not shown) and/or hose 406 may be jacketed with a controlled temperature fluid.

In operation, bladder 40 is filled with air or other fluid under pressure to provide a biasing force which urges shoe 10 forward toward glue applicator roll 101. In the absence of other external forces acting on shoe 10, wear elements 19 and the free edge 51 of blade 30 will engage outer surface 20 of glue roll 101. However, since cavity 22 is filled with glue and additional glue is being introduced into cavity 22 by pump 405, there is an external force on shoe 10 resulting from the pressure generated by pump 405 and this external force tends to move shoe 10 rearward or to the left with respect to FIG. 3. The net torque acting on shoe 10 around pivot 18 is counterclockwise. That is, the torque exerted by pump 405 on shoe 10 computed around pivot 18 exceeds the torque exerted by the fluid pressure in bladder 40 on shoe 10 around the same pivot 18, so that the net value of these torques tends to rotate shoe 10 rearward. Bladder 40 is positioned to exert more force on wear elements 19 than on blade 30, and cavity 22 is located closer to blade 30 than to wear elements 19, so that shoe 10 tends to pivot counterclockwise and wear element 19 stays in contact with cylinder surface 20. This causes shoe 10 to pivot slightly about its secondary axis 18. The pivoted mounting arms 14 for shoe 10 permit the location of main axis 97 to shift as required to accommodate pivotal motion of shoe 10 about secondary pivot 18. The net effect of this pivoting motion for shoe 10 is to separate the free end 51 of blade 30 from outer surface 20 of glue roll 101 to form a narrow distribution slot through which glue escapes from cavity 22 and deposits itself as a layer of controlled thickness on the portion of moving surface 20 downstream of blade 30.

It should now be obvious to those skilled in the art that the quantity of glue being forced from cavity 22 through the metering slot at free edge 51 of blade 30 is equal to the amount of glue being delivered by positive displacement pump 405. The width of this distribution slot adjusts itself automatically to accommodate the quantity of glue being delivered to cavity 22. That is, during a given time interval, if the quantity of glue being delivered by pump 405 increases, the same quantity must be forced from cavity 22 through the distribution slot. If the distribution slot were to remain at the same width, the pressure within cavity 22 would increase and thereby urge shoe 10 to pivot counterclockwise. However, to prevent pressure buildup in cavity 22, the metering slot at free end 51 of blade 30 automatically increases in width to permit an increased flow rate for the glue leaving cavity 22.

When precise control of the temperature for glue within cavity 22 is required, liquid of controlled temperature (either hot or cold) is circulated through passage 46. This liquid is introduced through fitting 48. It is noted that even though only one fitting 48 is shown connected to passage 46, there is at least one additional fitting 48 mounted to shoe 10 and connected to passage 46. Further, even though one fitting 47 is shown communicating with glue cavity 22 there may be a plurality of fittings 47 spaced along the length of shoe 10 for introduction of glue into cavity 22 at a plurality of locations along the length thereof.

It should now be apparent to those skilled in the art that relatively flexible sealing splines 26, 27 may be replaced by more rigid sealing strips (not shown) and spring elements which act between shoe means 10 and these sealing strips to bias the latter into sealing engagement with cylindrical surface 20. Wear elements 19 may be extended across the entire length of shoe means 10 and may also serve as a seal.

While the instant invention has been described in connection with metering of glue, it is noted the teachings of the instant invention may be utilized for metering in flexo ink systems. It is also noted that by removing pressure from the inside of bladder 40, the fluid metering gap between cylindrical surface 20 and free edge 51 of blade 30 may be opened sufficiently for entry into cavity 22 for cleaning thereof.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. Fluid metering means including a fluid carrying cylinder for applying a fluid film to a workpiece element moving relative to said cylinder; said fluid carrying cylinder being mounted for rotation on its relatively stationary cylindrical axis; shoe means extending parallel to said cylindrical axis; said fluid carrying cylinder having an outer cylindrical surface and said shoe means having a side confronting a portion of said cylindrical surface; a fluid cavity extending generally parallel to said cylindrical axis; said fluid cavity being formed by a depression in said side of said shoe means and being partially bounded by a portion of said cylindrical surface; first means engaging said cylindrical surface while said cylinder rotates and sealing said fluid cavity along its upstream edge; a fluid distribution slot partially bounded by said cylindrical surface and positioned along the downstream edge of said fluid cavity; said slot providing the sole opening through which fluid exits from said cavity; means movably mounting said shoe means to permit said fluid distribution slot to vary in thickness; biasing means urging said fluid distribution slot to close; a supply of essentially incompressible fluid; delivery means to deliver fluid under pressure from said supply to said fluid cavity at a known rate which is substantially independent of pressure in said fluid cavity and thereby create pressure within said fluid cavity urging said fluid distribution slot to open; said shoe means assuming an equilibrium position, under the control of opposing forces generated by said biasing means and said delivery means, whereby fluid is forced from said cavity through said slot to form a controlled fluid film on said cylindrical surface of said fluid carrying cylinder with said fluid film, without doctoring, being of a character suitable for application in final usable form directly to a workpiece element; and means acting independently of fluid viscosity and pressure variations over substantial ranges to synchronize operation of said delivery means with rotational speed of said fluid carrying cylinder; said delivery means maintaining said fluid cavity filled with fluid whereby, independently of fluid viscosity and rotational speed variations over substantial ranges, fluid is forced from said cavity through said slot at a rate equal to the rate at which said delivery means delivers fluid to said cavity.

2. Fluid metering means as set forth in claim 1 in which the fluid distribution slot is elongated, relatively narrow and of uniform thickness throughout the length thereof.

3. Fluid metering means as set forth in claim 1 in which the biasing means urging said fluid distribution slot to close is fluid operated.

4. Fluid metering means as set forth in claim 1 in which the shoe means is in operative mechanical engagement with the cylindrical surface so that said shoe means will move radially under control of the cylindrical surface pursuant to cylindrical imperfection in said cylindrical surface and/or if the latter rotates about an axis displaced from the axis about which the cylindrical surface is formed.

5. Fluid metering means as set forth in claim 4 in which the means floatingly mounting said shoe means includes arm means having first and second spaced parallel pivots extending generally parallel to the cylindrical axis; relatively stationary frame means to which said arm means is connected at said first pivot; said shoe means being connected to said arm means at said second pivot; said shoe means remaining in operative mechanical engagement with the cylindrical surface as said shoe means pivots about a third pivot to vary the width of the fluid metering slot; said arm means and said pivots being proportioned and operatively connected for enabling the shoe means to be pivoted away from the cylindrical surface sufficiently to permit access to said fluid cavity through said fluid metering slot, by enlarging the latter, for cleaning of said fluid cavity.

6. Fluid metering means as set forth in claim 1 in which the portion of the glue cavity midway between the upstream and downstream edges of said glue cavity, as measured at the cylindrical surface, is downstream of the point at which the force vector exerted by the biasing means intersects the cylindrical surface.

7. Fluid metering means as set forth in claim 1 also including scraper means disposed upstream of said first means and downstream of the location on said cylinder where a fluid film is applied to a workpiece element, said scraper means being in engagement with the cylindrical surface to remove fluid therefrom prior to application of fluid thereto at said fluid distribution slot.

8. Fluid metering means as set forth in claim 7 in which the first means includes a spline secured to said shoe means, said spline extending downstream and toward said cylindrical surface and being generally parallel to the cylindrical axis.

9. Fluid metering means as set forth in claim 7 in which the first means and the scraper means include respective first and second splines secured to said shoe means, said splines extending toward said cylindrical surface and being generally parallel to the cylindrical axis.

10. Fluid metering means as set forth in claim 9 in which the first and second splines extend downstream and upstream, respectively, from their respective areas of engagement with said shoe means.

11. Fluid metering means as set forth in claim 1 in which the fluid in said fluid cavity is an adhesive.

12. Fluid metering means as set forth in claim 1 in which the first means includes an elongated sealing element and resilient means biasing an edge of said sealing element into fluid sealing engagement with said cylindrical surfaces.

13. Fluid metering means as set forth in claim 1 in which the delivery means comprises a positive displacement device.

14. Fluid metering means as set forth in claim 1 in which the first means includes an elongated sealing element and resilient means biasing an edge of said sealing element into fluid sealing engagement with said cylindrical surfaces.

15. Fluid metering means as set forth in claim 1 also including sealing means secured to said shoe means closing the ends of the cavity and partially overlapping opposite ends of the cylinder.

16. Fluid metering means as set forth in claims 2, 3, 7, 8, 9, 11, 12 or 15 in which the delivery means comprises a positive displacement device.

17. Fluid metering means as set forth in claims 1, 11 or 13 in which the slot is located at the highest point of said cavity.

* * * * *